United States Patent [19]

Dickinson et al.

[11] Patent Number: 5,027,902

[45] Date of Patent: Jul. 2, 1991

[54] SELF-CYCLING PUMP APPARATUS AND METHOD

[75] Inventors: William D. Dickinson; James Mirand, both of Medina, N.Y.

[73] Assignee: American Sigma, Inc., Medina, N.Y.

[21] Appl. No.: 527,750

[22] Filed: May 21, 1990

[51] Int. Cl.[5] ..... E21B 43/12; E21B 34/10

[52] U.S. Cl. ..... 166/369; 166/105; 417/394; 137/625.66

[58] Field of Search ..... 166/369, 64, 66.4, 66.5, 166/105; 417/394, 478; 137/625.65, 625.66

[56] References Cited

U.S. PATENT DOCUMENTS 4,489,779 12/1984 Dickinson et al. ..... 166/64
4,585,060 4/1986 Bernardin et al. ..... 166/64
4,923,168 5/1990 Murata et al. ..... 137/625.66

FOREIGN PATENT DOCUMENTS

WO8201738 5/1982 PCT Int'l Appl. .

OTHER PUBLICATIONS

Millelburg, *Air-Operated Pump for Sampling Small Diameter Wells,* WRD Bulletin, Apr.-Jun. 1976, pp. 22-23.

*Procedures and Equipment for Groundwater Monitoring,* Sep. 1981, Industrial & Environmental Analysts, Inc., pp. 1-11.

*Performance Characteristics of I.E.A. Ground Water Sampling Pumps,* 1982 Industrial & Environmental Analysts, Inc., pp. 1-10.

*Primary Examiner*—William P. Neuder

*Attorney, Agent, or Firm*—Irving M. Weiner; Pamela S. Burt; Joseph P. Carrier

[57] ABSTRACT

A self-cycling pump apparatus wherein a valve functioning as a pump cycling device is connected to the pump so that it may be lowered together with the pump to a submerged position in a sub-surface fluid for lifing the sub-surface fluid to ground level. Separate drive air supply and exhaust tubes are connected to the cycling valve, the valve permitting the drive air supply line to communicate with a gas chamber of the pump during a pressurizing phase of the pump cycle, and alternately permitting the exhaust tube to communicate with the gas chamber of the pump during a venting phase of the pump cycle. A timing device for timing the sequence of the cycle phases is connected with the cycling valve. The timing device may be mounted adjacent the cycling valve, so that the pump, the cycling valve and the timing device may be lowered to the submerged operating position as a single unit.

33 Claims, 6 Drawing Sheets

FIG. 2A
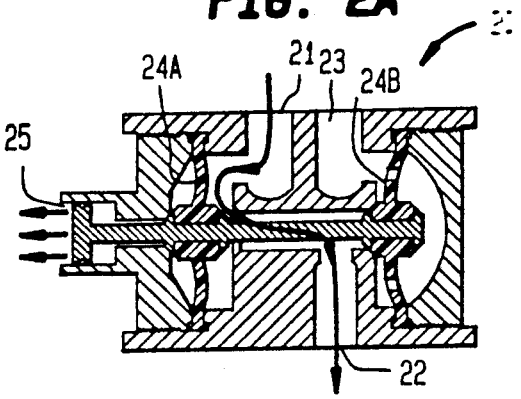
FIG. 2B
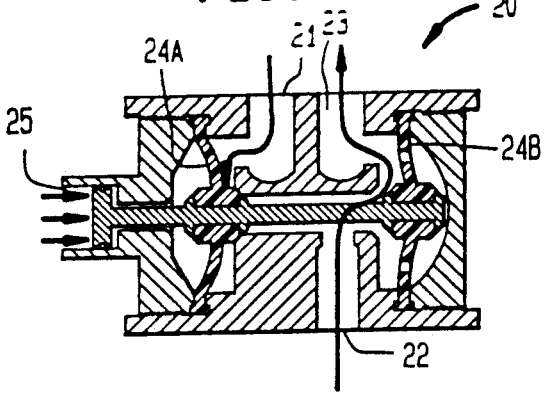
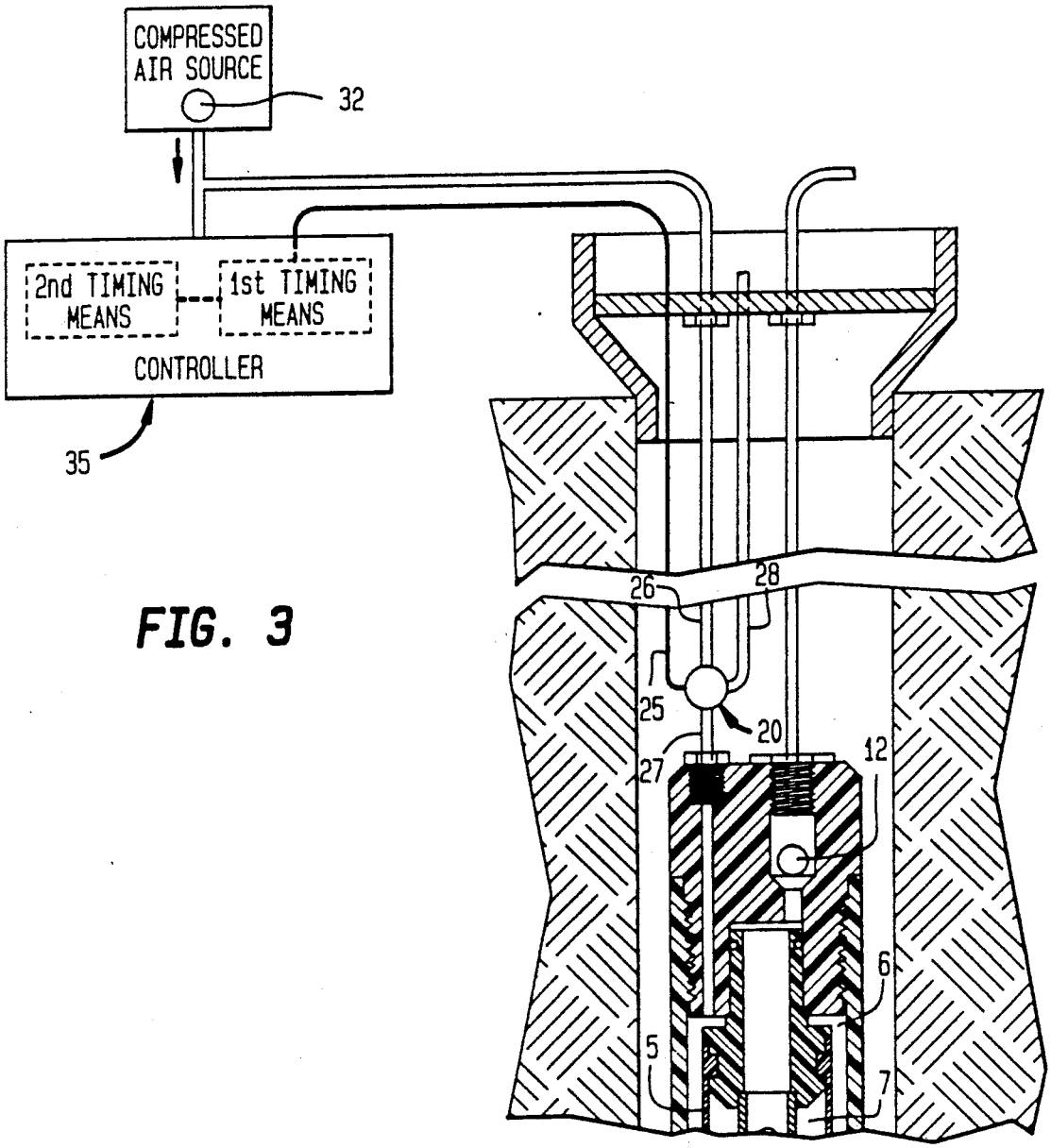
FIG. 3

SELF-CYCLING PUMP APPARATUS AND METHOD

BACKGROUND OF THE INVENTION

1. Field of the Invention

The present invention relates generally to self-cycling pump wherein valve means for alternating the discharge and re-fill stages of the pump cycle are provided directly at the pump disposed in the well. More particularly, the invention relates to a sub-surface pump provided with its own cycling means for alternately pressurizing and venting the pump, including a constantly-charged drive air supply line.

The terminology "sub-surface pump" as employed herein is intended to generally connote a pump used for lifting sub-surface fluids from subterranean depths, such as a bladder pump, a bellows pump or a gas drive pump, for example.

2. Description of Relevant Art

Mounting concerns over environmental pollution, and regulations imposed by the government, have greatly increased the use of sub-surface pumps used for groundwater sampling, recovery, and other types of operations in which sub-surface fluids are lifted from various depths to the ground surface. One type of sub-surface pump which has seen widespread use in groundwater sampling procedures is the conventional bladder pump.

Although bladder pumps are commonly used for groundwater sampling, their use in other applications has been limited. The performance characteristics of the bladder pump suffer proportionally to the depth at which the pump is disposed in the well due to limitations inherent in known arrangements. Although such limitations may not unduly impair sample collection from very shallow wells, they substantially impair sampling operations from greater depths. Such limitations also render the bladder pump unsuitable for use in other types of operations demanding relatively high flow rates, such as well purging operations.

As shown in FIG. 1, a conventional bladder pump comprises a rigid cylindrical pump body 1 having a lower inlet end and an upper outlet end. A generally cylindrical flexible bladder 5 (made of Teflon or the like) is disposed in pump body 1 so as to divide same into an outer annular actuating gas chamber 6 and an inner fluid chamber 7. A tube 8 extends through fluid chamber 7 within bladder 5, and is provided with opposite end retainers 9, 10 to which the opposite ends of bladder 5 are sealingly connected. Center tube 8 is apertured along its length to allow groundwater or other fluid to flow freely between the interior of tube 8 and the remainder of fluid chamber 7. A lower check valve 11 provided at the lower inlet end 2 permits groundwater or other fluid to pass therethrough into tube 8 and fluid chamber 7, and prevents the fluid from backflowing through the inlet from the pump interior. An upper check valve 12 permits fluid from chamber 7 to pass therethrough and be discharged through fluid conduit 13 for ultimate collection, and prevents the fluid from backflowing into the pump interior.

The conventional bladder pump is operated by alternately pressurizing and venting the gas chamber 6 so as to alternately contract and relax the bladder 5. When the pump is submerged, groundwater or other fluid flows into fluid chamber 7 via check valve 11 and tube 8 under the influence of natural hydrostatic pressure.

When an actuating gas such as compressed air is supplied to gas chamber 6, the flexible bladder 5 is compressed and lower check valve 11 is closed so that fluid in chamber 7 is forced upwardly through tube 8 and check valve 12, and discharged through conduit 13. The gas chamber 6 is then vented to permit bladder 5 to relax and expand as fluid again flows into fluid chamber 7 via check valve 11 and tube 8 under natural hydrostatic pressure, to start a new cycle.

In known bladder pump arrangements, such as disclosed in U.S. Pat. Nos. 4,489,779 and 4,585,060 for example, a portable ground-level controller 30 is connected between a compressed air source and a gas actuating conduit or air tube 14 communicating with the gas chamber 6 of the bladder pump. The controller includes cycling means, which alternates between pressurizing and venting modes so as to alternately pressurize and vent the bladder pump; and timing means, which times the cycling operations of the cycling means. The cycling means typically takes the form of a three-way valve which is alternately actuated and de-actuated to produce a pulsing flow from the bladder pump. Upon actuation, compressed gas is supplied to air tube 14; upon de-actuation, the compressed air source is blocked-off and the air tube 14 is vented to atmosphere. The controller includes electronic, pneumatic or mechanical timing means for automatically controlling the three-way valve.

The foregoing known arrangements for alternately pressurizing and venting the gas chamber 6 of the bladder pump rely on a single air tube 14 extending down the well from the ground surface to the pump, a distance which varies from several feet to hundreds of feet. Actuating gas in the form of compressed air is conveyed to the pump via tube 14 to cause the pump to discharge, and the compressed air is then vented to atmosphere through the same tube 14 to cause the pump to refill. The volume of air tube 14 which must be filled and vented for each complete cycle of the bladder pump varies with the depth at which the pump is installed in the well.

The performance characteristics of the above known arrangements are limited by and dependent upon the depth at which the bladder pump is installed in the well. The actuation (pressurization) time for the directional air valve of the controller is dependent upon variables including displacement of the compressed air source, lift and particularly the volume of air tube 14. Because 0.4333 psi per foot of lift is required to lift water, the entire air tube 14 must be charged to 0.4333 psi before the upper check valve 12 of the bladder pump will open to discharge water. Although this problem can be countered by reducing the diameter of tube 14 to reduce pressurization time, another problem arises. The time required for venting, i.e., de-actuation of the directional air valve, is dependent upon the head over the top of the pump intake (submergence), lift pressure, and the volume of air tube 14. To the extent that the diameter of air tube 14 is reduced, venting of the compressed air is constricted and valve de-actuation time is increased. Because venting time is reduced by maximizing the diameter of air tube 14, while pressurizing time is reduced by minimizing the diameter of air tube 14, any saving of time in one phase of the cycle will result in a loss of time in the other phase of the cycle.

The time required to complete a pumping cycle increases as the length of air tube 14 increases, imposing an undesirable limitation on the already limited pumping capacity of bladder pumps used in groundwater sampling applications.

Because the bladder pump is typically arranged such that the pump intake is disposed near the bottom of a groundwater monitoring well, the length of air tube 14 corresponds roughly to the depth of the well. In a monitoring well having a depth of 150 feet, for example, there will be approximately 150 feet of air tube which must be alternately pressurized to 0.4333 psi per foot of lift, and then vented, during each cycle of operation of the bladder pump. Because most monitoring wells are only two inches in diameter, the diameter of the bladder pump is limited and the volume of water capable of being pumped per cycle is correspondingly limited. The time consumed per pump cycle by having to alternately pressurize and vent the volume of air tube 14, together with the limited size of the pump, severely limit the pumping capacity attainable.

The present inventors have experimented with several different methods for increasing the limited pumping capability of a bladder pump in a groundwater sampling application. These methods include increasing the length of the bladder pump, varying the size of the water discharge porting and tubing, using a higher displacement compressed air source, modifying the controller, and/or varying the diameter of air tube 14. However, the effectiveness of each of these methods is limited by one or more factors, such as increased cost, decreased reliability, the confining dimensions of the well, etc. Moreover, regardless of which method is used, the improvement in pump performance is marginal relative to the extent that pump performance suffers by having to alternately pressurize and vent the full volume of air tube 14.

The present inventors experimented with different diameter air tubes 14 to determine the effect on pump performance of different air tube volumes. At a range of approximately 1 to 50 feet of lift, using 2.55 standard cubic feet per minute ("SCFM") at 100 psi air displacement, optimum performance was achieved using an air tube with approximately a ⅜" inside diameter ("I.D."). At a range of approximately 50 to 100 feet of lift, the optimum air tube I.D. was approximately ¼". At lifts exceeding approximately 100 feet, the optimum air tube I.D. was approximately 3/16". These results demonstrated that air tube volume affects pump performance differently at different lift and submergence conditions.

It is apparent from these results that the detrimental effect on pump performance of alternately pressurizing and venting the full volume of air tube 14 can be mitigated to some extent by adjusting the diameter of the air tube according to depth. However, the disadvantage arises that a variety of different diameter air tubes would be required to accommodate pump installations of varying depths. It is considerably more desirable to have a standard sized air tube for use in all applications.

Another alternative for partially overcoming the detrimental effect on pump performance of alternately pressurizing and venting the full volume of the air tube is to increase the capacity of the compressed air source. The air in tube 14 is thereby displaced more rapidly during pressurization to enhance performance during this phase of the pump cycle. However, this measure increases energy output while doing nothing to improve the performance detriment suffered during the venting phase of the cycle. The time it takes for the full volume of air tube 14 to be vented will remain as a factor inhibiting pumping capacity regardless of the characteristics of the compressed air source.

In groundwater monitoring, where samples are typically collected only weekly, bi-monthly, or even bi-annually, the chemistry of the groundwater begins to change within a couple of hours of leaving the sub-surface environment and entering the monitoring well. It is thus necessary to remove stagnant water from the well before sampling. Under current protocols, from three to ten standing volumes of water in the well must be purged before representative samples can be collected. Purging operations are the most time consuming part of the sampling procedure, and may occupy up to 98% of the overall time required for sampling.

To expedite purging, a gas-drive pump is often employed due to the limited pumping capabilities of the bladder pump. Gas-drive pumps are also commonly employed for recovery operations. However, there is a direct air-water interface in a gas-drive pump because compressed air communicates with the water. If low molecular weight components are contained in the pump body, where they are compressed and rapidly vented, vapors will be emitted from the discharge tube. The vapors can be hazardous, even explosive, and are generally detrimental to the environment. States which rigidly enforce air pollution standards may thus require that there be no air-water contact when pumping certain types of material from the well.

The bladder pump would be ideally suited for purging and recovery operations were it not for its limited pumping capability. In a bladder pump, there is no air-water contact because the bladder separates the air from the water in the pump. Thus, the venting of dangerous and environmentally harmful vapors throught the discharge tube is entirely eliminated.

The present invention greatly enhances the performance characteristics of the conventional bladder pump by eliminating the need to alternately pressurize and vent the large volume of air in tube 14 during each pump cycle. To this end, the invention provides the cycling means for the bladder pump at the pump itself, rendering the pump self-cycling. A bladder pump according to the invention is suitable for high flow-rate applications such as purging or recovery operations, and will hold pump performance substantially constant regardless of the depth of the well.

SUMMARY OF THE INVENTION

The present invention provides a self-cycling pump apparatus, comprising: a pump adapted to be disposed in a submerged subterranean position to lift sub-surface fluids to ground level; pump cycling means, connected between a source of working fluid and the pump, for alternately establishing a pressurizing mode of operation and a venting mode of operation of the pump; the pump cycling means being mounted adjacent the pump and communicating with an inlet of a gas actuating chamber of the pump; and timing means connected with the pump cycling means for controlling the sequential timing of the alternate pressurizing and venting modes of operation.

The invention further provides a fully self-controlled pump apparatus, comprising: a pump adapted to be disposed at a subterranean position, submerged in sub-surface fluid, to lift the sub-surface fluid to ground level; pump cycling means, connected between a source of working fluid and the pump, for alternately establishing a pressurizing mode of operation and a venting mode of operation of the pump; the pump cycling means being mounted adjacent the pump and communicating with an inlet of a gas chamber of the pump; and timing means connected with the pump cycling means for controlling the sequential timing of the alternate pressurizing and venting modes of operation, the timing means being mounted adjacent the pump cycling means when the pump is in the submerged position.

The invention further provides a method of lifting sub-surface fluid to ground level wherein the pump, the pump cycling means and the timing means are lowered down a well as a unit and positioned at the submerged operating position of the pump.

It is an object of the present invention to eliminate the need to alternately pressurize and vent the large volume of air in the air tube during each pump cycle, as required in known arrangements. To this end, the cycling means for the bladder pump is provided at the top of the pump itself, rather than in the ground level cycle controller as in known arrangements. The cycling means may take the form of a three-way valve mounted at the top of the pump and connected via a short conduit to the gas chamber of the bladder pump. The invention thus reduces the volume of gas conduit which must be charged to lift pressure to just a short length, while comparably reducing the volume of conduit which must be vented during each cycle.

The self-cycling bladder pump of the invention includes separate air supply and vent tubes extending down the well from ground level. Because the air supply tube is not used for venting, it functions as a header and remains constantly charged with compressed air. When the cycling means at the pump is actuated, air is immediately introduced to the gas chamber of the pump to effect the discharge half of the cycle. When the cycling means is de-actuated, the pump vents the small volume of air from the pump chamber and the pressure/vent conduit through the separate vent tube to atmosphere. The time delays encountered in known arrangements, wherein the entire volume of air tube 14 must be alternately charged and vented, are thus substantially eliminated by the present invention.

Pump performance is significantly improved with the self-cycling bladder pump of the invention. A much flatter flow curve is attained because the normal performance drop per foot of lift is substantially eliminated. Fill and discharge times may be reduced by as much as 80% in comparison with known arrangements, and flow rate will be virtually the same at any lift. Also, because the air consumption rate is vastly decreased, the capacity of the compressed air source may be reduced. The invention thus makes small portable compressed air cylinders practical for use with bladder pumps, or permits the use of a smaller displacement compressor than has heretofore been required.

The above and further objects, details and advantages of the invention will become apparent from the following detailed description of preferred embodiments thereof, when read in conjunction with the accompanying drawings.

BRIEF DESCRIPTION OF THE DRAWINGS

FIGS. 2A and 2B are cross-sectional views of a three-way valve for use as the cycling means of the invention, with FIG. 2A showing the valve in a normally-open state and FIG. 2B showing the valve in a closed state.

FIG. 3 is a partially cut-away view of a self-cycling bladder pump according to a first embodiment of the invention provided with a pump-mounted, air-piloted cycling valve controlled by remote pneumatic timing means.

DETAILED DESCRIPTION OF PREFERRED EMBODIMENTS

Figure 1:
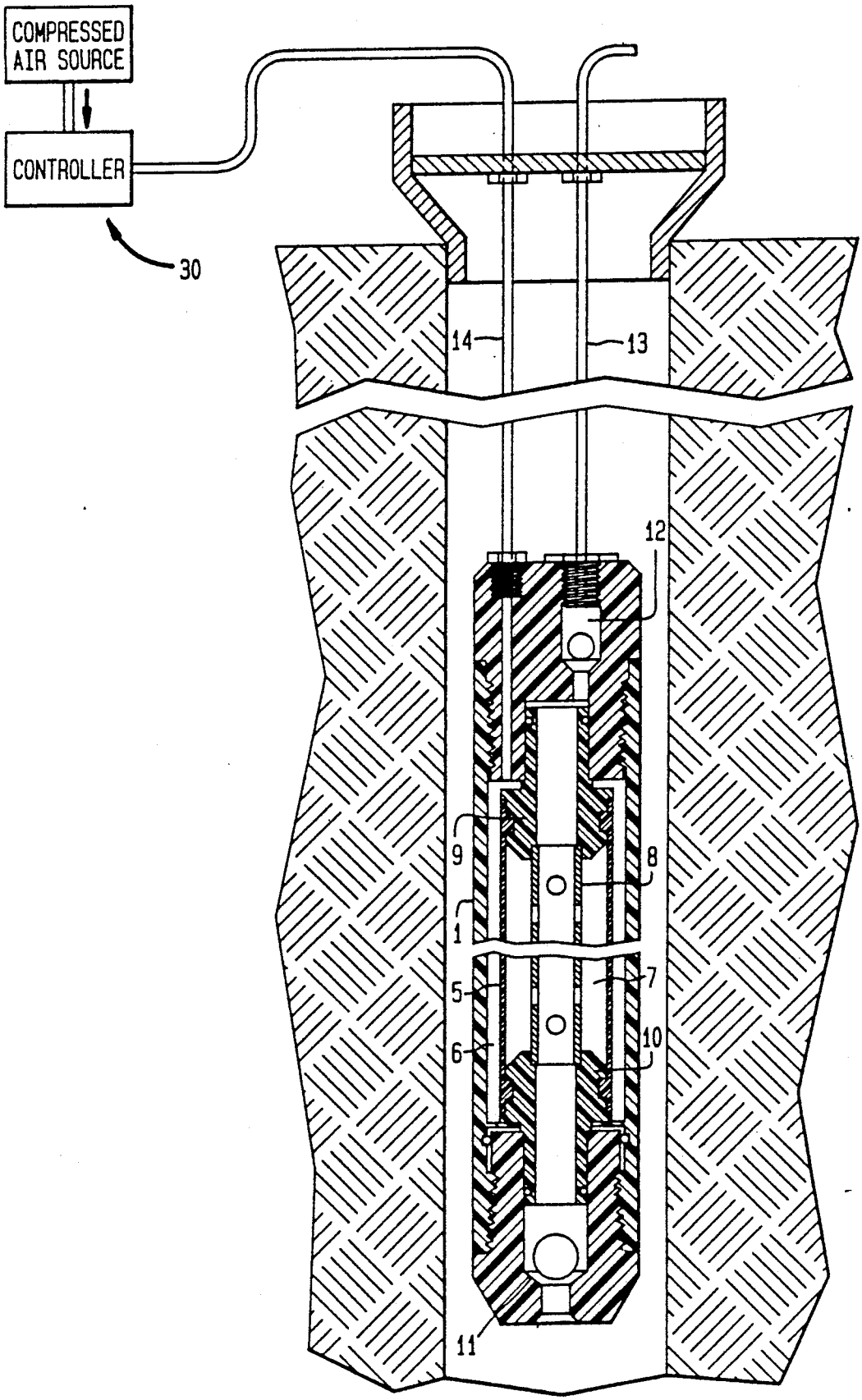
FIG. 1 (PRIOR ART)
FIG. 1 is a view of a conventional bladder pump arrangement shown partly in section, with the bladder pump installed in a well.

A first embodiment of the self-cycling bladder pump according to the invention will be described with reference to FIGS. 2A, 2B and 3, in which the cycling means takes the form of an air-piloted cycling valve 20 mounted at the upper end of the bladder pump.

The cycling valve 20 comprises a three-way pilot-actuated air valve as shown in FIGS. 2A and 2B. In this embodiment the valve 20 is a normally-open diaphragm type valve, the normally-open state of the valve being shown in FIG. 2A and the closed state of the valve being shown in FIG. 2B. Valve 20 includes an inlet port 21, an outlet or cylinder port 22, and an exhaust port 23. The diaphragms 24A, 24B of valve 20 cooperate with inlet port 21 and exhaust port 23 so that when compressed air enters through inlet port 21 it will exit through outlet port 22 in the normally-open state shown in FIG. 2A. On the other hand, when the diaphragms 24A, 24B of valve 20 move to the valve-closed state of FIG. 2B in response to air pressure supplied by pilot line 25, the outlet port 22 will communicate with the exhaust port 23 and is blocked from communication with the inlet port 21.

The pilot line 25 provides a pilot signal, e.g., compressed air at a predetermined amount of psi, to the diaphragms 24A, 24B so as to close valve 20 (FIG. 2B). The pilot line 25 has a very small diameter, i.e., as small as only a few thousandths of an inch. The pressure required to be applied to the diaphragm to close the valve 20 is variable, e.g., 30 psi, 60 psi, etc.

FIG. 3 shows the valve 20 schematically, as incorporated in a bladder pump control system according to the invention. The valve 20 is mounted at the upper end of the bladder pump as shown. A gas actuating conduit or drive air tube 26 is connected to the inlet port 21 of valve 20, a pressure/vent conduit 27 is connected between the outlet port 22 of valve 20 and the inlet to gas chamber 6 of the bladder pump, and an exhaust tube 28 is connected to the exhaust port 23 of valve 20. The drive air tube 26 and pilot line 25 each extend from the valve 20 up to the ground surface or wellhead assembly. The exhaust tube 28 may extend upwardly to a point either beneath or above the well closure, provided that its upper end is disposed a sufficient distance above the liquid level in the well so as not to be submerged at fluctuating liquid levels. The pressure/vent conduit 27, however, extends only a short distance from the valve 20 to the inlet of the bladder pump gas chamber 6. Although conduit 27 as shown in FIG. 3 has a length of several inches, it will be understood that the conduit 27 may instead be defined by any suitable type of fitting for connecting the outlet port 22 of valve 20 with the inlet to pump gas chamber 6.

As also shown in FIG. 3, a compressed air source, such as a compressor or compressed air cylinder, is connected to a controller 35 having timing means for automatically controlling the cycling valve 20. The air line connecting the compressor to controller 35 is branched to communicate directly with drive air tube 26 so that pressurized air will fully charge or pressurize the tube 26 upon operation of the compressor. The controller 35 is provided with first and second timing means, which may be electronic, pneumatic or mechanical, to which pilot line 25 is operably connected.

The operation of the cycling means (valve 20) of the bladder pump is governed by pilot line 25 connected to controller 35. Rather than having to fully charge the volume of an air tube extending from the ground surface to the pump to 0.4333 psi per foot of lift to cause the pump to discharge, as required in known arrangements, a self-cycling bladder pump according to the invention will be signalled to discharge in response to a relatively minute supply of air. The very small diameter pilot line 25, controlled by the timing means of controller 35, moves diaphragms 24A, 24B from the normal valve-open position to a valve-closed position in response to only a minimal pressure of 30 psi, for example. The drive air tube 26 remains charged at all times, ready to supply air to gas chamber 6 of the pump through conduit 27 under the control of diaphragms 24A, 24B.

The hysteresis of valve 20, i.e., the difference in pressure required to move the diaphragms between the valve open and valve closed positions, may be selected so that the valve is responsive to low pressure pilot signals. By way of example, the valve 20 may be rated for 30% hysteresis, so that the valve is open at 20 psi and will close once pressure is increased to 30 psi. To re-open the valve 20 for the next cycle, the pilot line 25 need not be vented entirely, but rather only 10 psi need be vented from the small-diameter line. The cycle time consumed by this minimal venting or bleeding process is minute in comparison with known arrangements which require the entire volume of air tube 14 to be vented before the next cycle can begin. Because the invention includes a separate exhaust tube 28, the function of which is limited to venting chamber 6 during the fluid intake half of the cycle, a new cycle can be timed to begin as soon as the air in chamber 6 and the short length of pressure/vent conduit 27 has been vented. Likewise, the cycle time consumed for completely charging air tube 14 for pump discharge in known arrangements is substantially eliminated by the present invention because drive air tube 26 remains charged at all times.

The general operation characteristics of the control system according to the invention are as follows.

The valve 20 may be of either a normally-open or normally-closed type. For the normally-open valve 20 shown in FIGS. 2A, 2B, drive air tube 26 and pressure/vent conduit 27 communicate with each other in the normally open state, with the exhaust tube 28 being blocked-off. Assuming that valve 20 is rated for 30% hysteresis with pilot line 25 supplying 20 psi to the diaphragm during the normally-open state, an increase to 30 psi in pilot line 25 will cause the valve 20 to close as shown in FIG. 2B, so that pressure/vent conduit 27 communicates with exhaust tube 28 rather than drive air tube 26.

With the normally-open valve 20, as soon as drive air tube 26 connected with the compressed air source is charged, the bladder pump will be actuated to a discharge mode. The first timing means in the controller is adjusted so that the pressure in pilot line 25 is increased from 20 psi to 30 psi within a couple of seconds, causing valve 20 to close. When valve 20 is closed, communication between air drive tube 26 and pressure/vent conduit 27 is blocked-off, and the pressure/vent conduit 27 communicates with exhaust tube 28. The second or delay timing means of controller 35 is adjusted to permit the valve 20 to remain closed for a period of time which permits the volume of air in gas chamber 6 and pressure/vent conduit 27 to be vented. When venting is complete, the pressure in pilot line 25 is decreased back to 20 psi to re-open valve 20. The drive air tube 26 will then communicate with pressure/vent conduit 27 again to start a new pump cycle.

The second timing means 35 may comprise a pneumatic time-delay relay of a known type. For example, a fixed-volume variable orifice means may be employed wherein compressed air is received in a chamber, with the rate of bleed-off controlling the length of the desired time lapse. Alternatively, a variable-volume fixed orifice means may be employed for the second timing means.

During the intake half of the cycle, while venting occurs through exhaust tube 28, the drive air tube 26 remains substantially fully charged, and stands ready to supply compressed air for the discharge half of the cycle. During the discharge half of the cycle, the exhaust tube 28 stands ready for venting during the next intake half of the cycle. Control of the cycling is effected entirely by the change in pressure in pilot line 25 as controlled by the remote timing means in controller The valve 20 mounted at the upper end of the bladder pump thus renders the bladder pump self-cycling. Because cycling operations occur at the pump rather than remotely at the ground-level controller in known arrangements, the entire volume of the air tube extending down the well need not be pressurized and vented during each cycle. Instead, the drive air tube 26 of the invention remains charged at all times, and venting takes place through separate tube 28. This arrangement optimizes performance of the bladder pump regardless of the depth at which it is disposed, and reduces cycling time sufficiently to effect a significant improvement in flow rate.

To measure the improvement in pump performance afforded by the control system according to the invention, the present inventors performed comparison tests between a modified bladder pump arrangement of conventional design and one embodying the self-cycling principle of the present invention.

1. Tests with Conventional Bladder Pump Arrangement

In the first test series, a standard cycle controller having a built-in cycling means in the form of a directional valve for alternately pressurizing and venting air tube 14 (FIG. 1) was used with a bladder pump modified to maximize pumping capacity. The center tube 8 of the bladder pump was replaced with a ½" I.D., ⅝" O.D. copper tube. The check valves 9, 11 were replaced with large ported valves normally used with a gas drive pump. The pump body was increased to a length of 69", and standard bladder material was installed. An air tube 14 of ⅜" I.D., ½" O.D., and a water discharge tube 13 of ⅝" I.D., ¾" O.D. was used. Lift points down to a level of 100 feet were tested, with the air tube 14 being cut to a length equal to the lift at each lift point. The following flow rates were obtained:

TABLE 1

| Lift (feet) | Flow Rate (gpm) |
|---|---|
| 10 | 3.8 |
| 44 | 3.6 (26 feet submergence) |
| 52 | 3.2 |
| 60 | 3.0 |
| 68 | 2.75 |
| 76 | 2.5 |
| 92 | 2.1 |
| 100 | 1.7 (80 feet submergence) |

(3.3 SCFM @ 125 psi)

Although these results reflect an increase of approximately two times the flow rate of a standard unmodified bladder pump, they also establish that flow rate decreases substantially with increasing lift when the known control arrangement is used.

2. Tests with the Control System of the Present Invention

The self-cycling bladder pump of the present invention (FIG. 3) was used in the second series of test, with various parameters used in the first test series being held constant. The drive air tube 26, the exhaust tube 28 and the pressure/vent conduit 27 all had the same inner and outer diameter dimensions as the air tube 14 used in the first test series, i.e., ⅜" I.D., ½" O.D. The water discharge conduit 13 had the same inner and outer diameter dimensions as that in the first test series, i.e., ⅝" I.D., ¾" O.D. The bladder pump had the same modifications described in the first test series. Tests were conducted using 3.3 SCFM @ 125 psi, as in the first test series.

A pneumatic Humphrey diaphragm-type three-way air valve was installed at the upper end of the pump for use as valve 20 described with reference to FIG. 3. The valve was approximately 1⅛" in length and ⅞" in diameter. The pilot line 25 used was ⅛" I.D., ¼" O.D.

A first test run, conducted from 100 feet of lift (100 feet of tubing) with 80 feet of submergence, yielded a flow rate of 3.2 gpm. A second test run, also at 100 feet of lift with 80 feet of submergence, yielded a flow rate of 3.75 gpm.

The flow rates obtained in this second test series, using the self-cycling bladder pump of the invention, increased the flow rate at 100 feet of lift from 1.7 gpm in the first test series to 3.2–3.75 gpm. On average, the control system of the present invention thus substantially doubled the flow rate obtained with the known control arrangement, even where the bladder pump used in the known arrangement had been modified to maximize flow rate.

The dimensions of the tubing, the valve and the valve ports used in the foregoing example may of course be modified as desired. For example, the pilot line 25 may be of a greatly reduced diameter, e.g., only several thousandths of an inch. The air drive tube 26 can be enlarged to accommodate larger bladder pumps in larger-diameter wells; and the pressure/vent conduit 27, exhaust tube 28, fluid discharge conduit 13, and valve 20 can be modified according to the particular installation, if desired.

Although in the foregoing embodiments the valve 20 has been described as a diaphragm valve, it will be understood that other types of valves having at least three ports may alternatively be employed. For example, a spool valve, a poppet valve, a quick exhaust valve, or any other type of three-ported directional air valve capable of the general operating characteristics of valve 20 may be employed. A valve with more than three ports, such as a four-way valve or a five-way valve, may also be desirable for use in the foregoing embodiments, with the extra port or two being plugged. By using a four- or five-way valve, plugs can be selectively removed when it is desired to use the extra port(s) for other applications.

Although other types of directional air valves may be employed, a diaphragm valve is particularly well suited for miniaturization without constricting flow, so that the valve body may be kept small enough to readily fit on top of a small diameter pump in a two-inch diameter well. Other advantages afforded by a diaphragm valve are that it requires no lubrication, and the user can easily replace a worn diaphragm as needed. Where a flexible diaphragm is used, the diaphragm may be made of material having very favorable elastomeric characteristics (Buna N, neoprene, etc.) so that reliability will be very high. It is also contemplated, however, that a non-flex diaphragm/poppet valve may be employed to improve response time and ensure proper diaphragm seating.

Another improvement attained by the present invention relates to the regulation of flow rate. To collect groundwater samples at a desired slow rate, known arrangements include a pressure regulator for decreasing air pressure, to in turn decrease flow rate. Instead of a pressure regulator, the present invention contemplates the use of a control valve attached to the compressor to regulate air displacement rather than pressure. To this end, a needle valve, gate valve, etc., indicated by reference numeral 32 in FIG. 3, is connected to the compressor to regulate displacement, and in turn regulate flow rate. This simple valve arrangement is mechanically simplified and relatively inexpensive in comparison with known pressure regulator arrangements.

A modification of the above-described first embodiment of the invention will be described below with reference to FIGS. 6A, 6B and 7, wherein a quick exhaust valve is incorporated in the self-cycling bladder pump to improve pump performance.

Figure 6A:
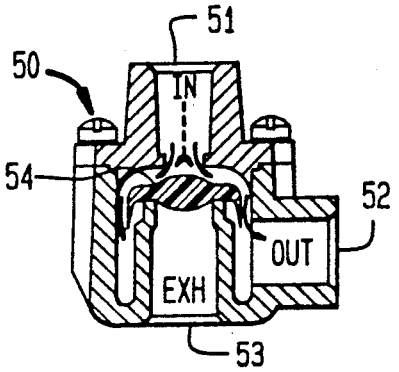
FIGS. 6A and 6B are cross-sectional views of a quick exhaust valve for use in a modification of the first embodiment of the invention.
Figure 6B:
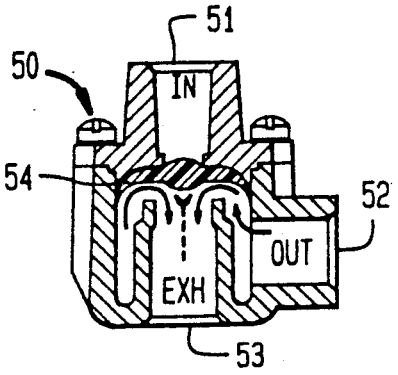

FIGS. 6A and 6B depict a quick exhaust valve 50 adapted to be connected between the cycling valve 20 and the pump. The valve 50 includes an inlet port 51, an outlet port 52, an exhaust port 53, and a shuttle 54 for controlling air flow through the valve. In FIG. 6A, the shuttle 54 is in a lowered position, so that the exhaust port 53 is closed off and compressed air supplied through inlet port 51 will exit through outlet port 52. In the exhaust mode shown in FIG. 6B, on the other hand, the shuttle 54 is moved upwardly to close off inlet port 51, so that air entering through outlet port 52 will exit through exhaust port 53.

Figure 7:
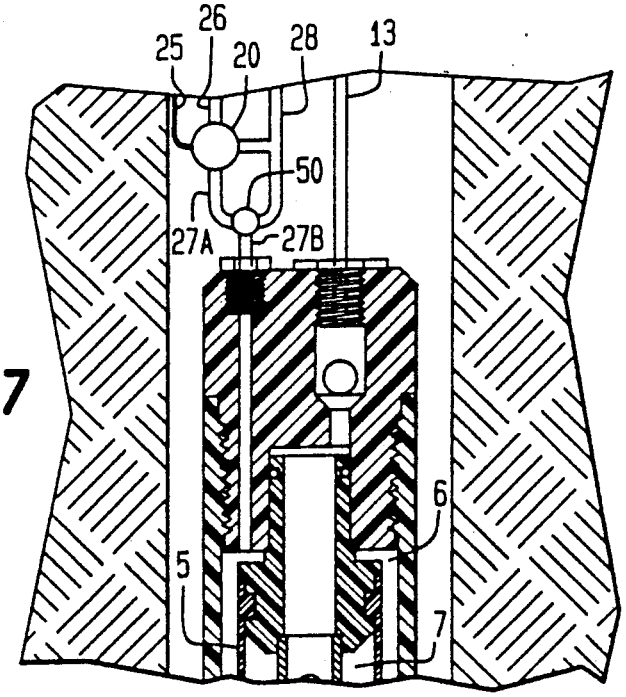
FIG. 7 is a cut-away view of a modification of the first embodiment of the invention, incorporating the quick exhaust valve of FIGS. 6A and 6B.

In FIG. 7, the quick exhaust valve 50 is shown operably connected between cycling valve 20 and the inlet to gas chamber 6 of the bladder pump. In this modification of the first embodiment, the outlet port of cycling valve 20 is connected via a first pressure/vent conduit portion 27A to the inlet port 51 of quick exhaust valve 50. The outlet port 52 of valve 50 is in turn connected via a second pressure/vent conduit portion 27B to the inlet to gas chamber 6 of the pump. The exhaust port 53 of valve 50 is connected to exhaust tube 28, while the exhaust port of cycling valve 20 also communicates with exhaust tube 28 as shown.

In operation, during the pump discharge mode, when cycling valve 20 is in its normally-open state as shown in FIG. 2A, quick exhaust valve 50 will also be in its open state as shown in FIG. 6A. Compressed air will thus pass through cycling valve 20, first pressure/vent conduit portion 27A, quick exhaust valve 50, and second pressure/vent conduit portion 27B to the inlet of gas chamber 6 of the pump. When the pressure in pilot line 25 is increased to close cycling valve 20 for the pump intake phase of the cycle (FIG. 2B), the quick exhaust valve 50 likewise closes as shown in FIG. 6B. Air will thus be vented from gas chamber 6 through the second pressure/vent conduit portion 27B, the quick exhaust valve 50, and upwardly through exhaust tube 28. Simultaneously, air in the first pressure/vent conduit portion 27A will be exhausted through valve 20 and upwardly through exhaust tube 28.

With the modified version of the first embodiment incorporating quick exhaust valve 50 as shown in FIG. 7, the intake phase of the pump cycle is reduced to improve pump refill time. The quick exhaust valve 50 permits a relatively large volume of air to pass therethrough in a relatively short period of time, so that the volume of gas chamber 6 can be vented very rapidly. The improved venting permitted by virtue of quick exhaust valve 50 will in turn enhance pump performance by reducing the time required for the intake phase of the cycle.

Figure 4:
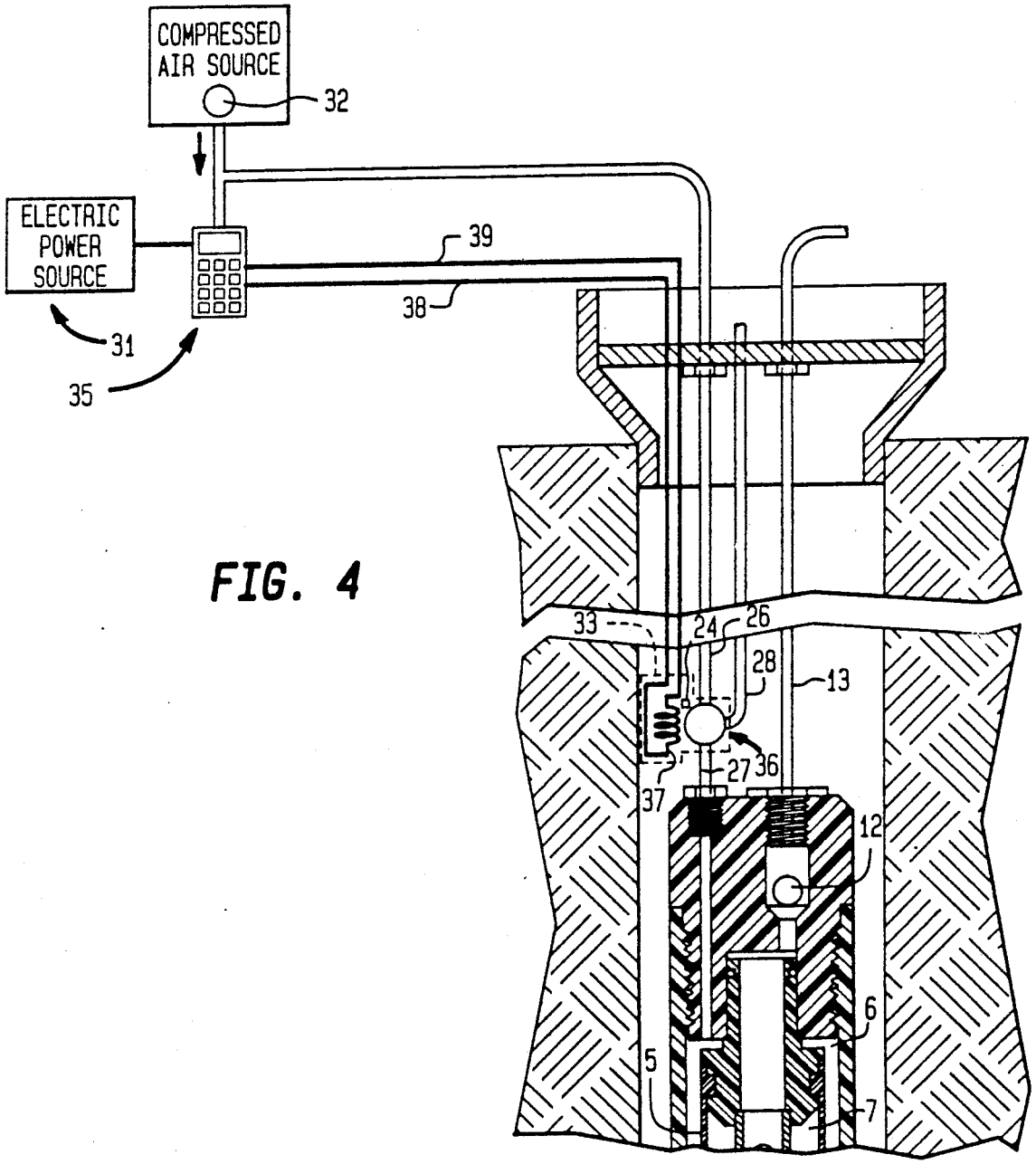
FIG. 4 is a partially cut-away view of a self-cycling bladder pump according to a second embodiment of the invention provided with a pump-mounted, solenoid-operated cycling valve.

In an alternative embodiment shown in FIG. 4, the air-piloted valve 20 is replaced by a solenoid-operated spool valve 36 which is electromagnetically actuated. The valve 36 is connected with drive air tube 26, exhaust tube 28 and pressure/vent conduit 27 substantially as described with reference to valve 20. The general operating characteristics of valve 36 are the same as those of valve 20, except that in this embodiment an electric solenoid 37 supplied with electrical power is mounted in a waterproof manner (i.e., an appropriate NEMA rating) in a casing 33 to operate spool valve 36. Electric energy applied to the solenoid coil 37 via electrical conduits 38, 39 creates a magnetic field which draws an armature into the coil. The armature motion is transmitted through a push rod which in turn moves the spool.

An advantage afforded by the FIG. 4 embodiment is that because electric solid-state timers can be miniaturized to the size of a small chip, the timing means 34 can be mounted directly in the casing 33 with the valve. A remote electric controller means 35', connected with an electric power source 31 such as a battery, can also be greatly reduced in size relative to known controllers. Whereas a standard conventional controller is the size of a small suitcase, the controller 35' in this embodiment may be as small as a hand-held calculator, as shown.

Another embodiment of the invention, in which an entire controller means including both cycling means and timing means is mounted at the bladder pump, will be described below with reference to FIG. 5.

Because a large groundwater monitoring site may have many monitoring e.g., thirty or more, but only one portable cycle controller which is moved from well to well, a number of problems arise. Samples spoil after a predetermined holding time, which may be as short as 6 or 7 hours for some parameters, so that sampling procedures must be scheduled to ensure that samples arrive at the laboratory for analysis before their holding times expire. If the known type of portable cycle controller should fail, all of the thirty or more pumps will be inoperable at the same time. The known controllers are not user-serviceable, so that considerable down time may result when they are returned to the factory for repair.

Figure 5:
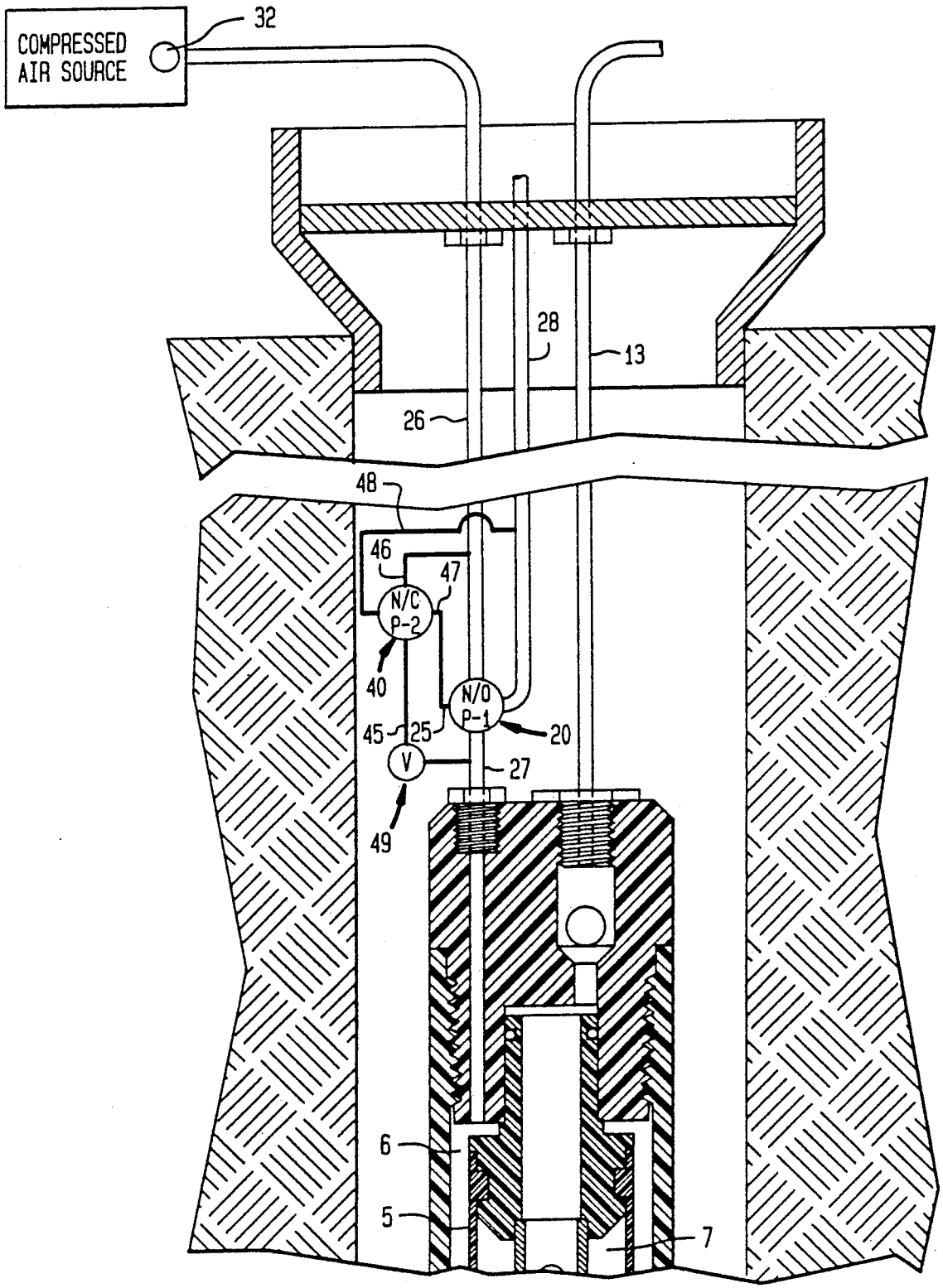
FIG. 5 is a partially cut-away view of a self-cycling bladder pump according to a third embodiment of the invention, in which both the cycling means and the timing means are mounted directly at the pump.

The embodiment of the invention shown in FIG. 5 effectively overcomes these problems by providing an entire controller on the top of the pump itself, eliminating the need for a remote ground-level controller by providing each pump with its own individual cycling and timing means mounted at the pump. The bladder pump is thus rendered not only self-cycling, but entirely self-controlled.

The FIG. 5 embodiment utilizes the gas chamber of the bladder pump itself as part of the timing means for controlling cycling of valve 20. A second timing means is provided by an additional valve arrangement operably connected with valve 20 at the top of the pump. The pump-mounted controller of FIG. 5 is user-serviceable, and should it fail, will render only a single pump inoperable for a short time.

In FIG. 5, the normally-open three-way valve 20 of the FIG. 3 embodiment is connected with a second normally-closed three-way valve 40, arranged adjacent to valve 20, as described below. Although valve 40 is normally-closed, in all other respects it is subtantially the same in structure and function to valve 20.

Normally-closed valve 40 has inlet tube 46 connected to the inlet port thereof, outlet tube 47 connected to the outlet port thereof, and exhaust tube 48 connected to the exhaust port thereof. Pilot line 45 is pressurized to move the diaphragms of valve 40 from their normally-closed state to an open state, in the opposite manner of valve 20.

The valves 20 and 40 communicate with each other as follows. The drive air tube 26 connected to the inlet of valve 20 communicates with the inlet tube 46 of valve 40, and the exhaust tube 28 connected to the exhaust port of valve 20 communicates with the exhaust tube 48 of valve 40. The pilot line 25 of valve 20 communicates with the outlet tube 47 of valve 40, and may comprise a single length of tube. The pressure/vent conduit 27 connected to the outlet port of valve 20 communicates with the pilot line 45 of valve 40.

The arrangement of valves 20 and 40 as shown in FIG. 5 eliminates the need to run pilot line 25 down the length of the well to valve 20, and moreover renders the bladder pump entirely self-controlled. Further, the self-controlled bladder pump is self-adjusting to accommodate different lifts, different submergences, etc.

In operation, when the drive air line 26 is initially charged with compressed air from the compressed air source, valve 20 in its normally-open state will permit air to be supplied through pressure/vent conduit 27 to gas chamber 6 of the bladder pump, as in the first embodiment. As the volume of gas chamber 6 is filled to collapse bladder 5, air will also be supplied to pilot line 45 of valve 40, which is connected with pressure/vent conduit 27. When a predetermined actuating pressure is reached in pilot line 45, i.e., in accordance with its predetermined hysteresis, the normally-closed valve 40 will open. When valve 40 opens, the inlet tube 46 thereof communicates with the outlet tube 47, so that air passes through valve 40 and outlet tube 47 communicating with pilot line 25 of valve 20. Upon pressurization of pilot line 25 to the appropriate closing pilot signal pressure (based on the hysteresis of valve 20), valve 20 will close so that the bladder pump will vent. Once the volume of gas chamber 6 is entirely exhausted, and pilot line 45 has vented to allow normally-closed valve 40 to close and normally-open valve 20 to in turn open, a new cycle will begin automatically.

To control timing during the foregoing operation, a valve 49 is arranged in pilot line 45 leading from the pressure/vent conduit 27 to the pilot of normally-closed valve 40. Any suitable valve for regulating air supply through pilot line 45 may be employed, e.g., a needle valve. The pressurized air received through the length of pilot line 45 between conduit 27 and valve 49 will be sent as a pilot signal to valve 40 in accordance with the hysteresis of valve 49, so that valve 49 will control the timing for opening of normally-closed valve 45 and in turn the closing of normally-open valve 20. To this end, the bleed-off of valve 49 may be adjusted so that the proper pilot signal will be sent to valve 40 to open same at the proper time. The proper timing of the discharge and venting halves of the pump cycle can thus be set so that optimal pump performance is attained.

The novel fundamental principle of the FIG. 5 embodiment is to provide additional valve means to control timing operation of the bladder cycling valve 20 at the pump itself, rather than relying on remote ground-level cycle timing means for valve 20, so that the bladder pump is entirely self-controlled. The additional valve means, in this case the arrangement of normally-closed valve 40, permits the gas chamber 6 of the bladder pump itself to serve as the pump-discharge timing chamber, while the valve 49 serves as the second or pump-filling timing means.

The design of the pump-mounted controller is not limited to the specific arrangement shown in FIG. 5. It is contemplated, for example, that valve 20 may be a normally-closed valve and valve 45 a normally-open valve. Further, various other suitable valve arrangements may be connected with valve 20 and pressure/vent conduit 27 to achieve the fundamental self-controlling pump principle of the FIG. 5 embodiment.

The response times achieved with the FIG. 5 embodiment are reduced to the order of micro-seconds, so that the enhanced pump performance attained with pump-mounted cycling valve 20 of the first embodiment is even further enhanced in this embodiment.

As in the first embodiment, valves 20 and 45 may comprise any suitable known type of at least three-way valve, and preferably a diaphragm valve due to its enhanced reliability. One desirable type of valve for use as at least valve 45 is a non-flex diaphragm/poppet type valve, which will ensure proper diaphragm seating.

Because the valves selected for use in the FIG. 5 arrangement are preferably rated for long-term reliability, e.g., on the order of millions of cycles, the reliability of the FIG. 5 self-controlled pump will be very high. Should one of the valves fail, it can be readily serviced by the user at the site, so that down time is minimized.

The FIG. 5 embodiment renders the bladder pump and with its completely integrated control means a single unitary structure. The entirely self-controlled pump can be dropped into the well as a single unit.

It will be understood that the various embodiments of the present invention are equally applicable for use with a "bellows" type pump having the same general operational characteristics of the conventional bladder pump of FIG. 1, but with the gas and fluid chambers reversed. In a bellows pump, the annular space between the outside of the bladder 5 and the inside of pump body 1, i.e., chamber 6, functions as the fluid chamber, while the chamber 7 within the bladder functions as the gas or air chamber. The intake and discharge valves, as well as fluid discharge conduit 13, are arranged to communicate with annular chamber 6, while air tube 14 communicates with chamber 7. The bladder 5 is compressed as fluid enters chamber 6 through the lower intake valve, and the bladder 5 is inflated to discharge water from chamber 6, in an opposite manner to the conventional bladder pump. Like the conventional bladder pump, the gas chamber of the bellows pump (in this case chamber 6) must be alternately pressurized and vented. By providing the bellows pump with its own cycling means according to the invention, a bellows pump would be rendered self-cycling in the same manner as described above with respect to FIG. 3. By providing the bellows pump with its own cycling and timing means in accordance with the FIG. 5 embodiment, the bellows pump would be rendered entirely self-controlled.

It will thus be understood that the various embodiments of the invention may be used in any situation where fluids are being lifted from depths by an alternately pressurized and vented pump, whether for sampling purposes, purging purposes, recovery purposes, etc. In addition to bladder pumps and bellows pumps, the invention may also be adapted for use with gas drive pumps, for example cycling valve 20 renders the gas drive pump 70 self-cycling in the same manner as it does the bladder pump as described above with reference to FIG. 3. The structure and function of controller 35, valve 20, drive air tube 26, separate exhaust tube 28, etc., are the same as described above, with valve 20 being opened and closed by pilot signal via pilot line 20 to alternately communicate fluid chamber 71 of pump 70 with drive air tube 26 and exhaust tube 28.

The components of the pump-mounted control valve arrangements are very inexpensive, so that they may be left substantially permanently in a given well. Alternatively, they may be portable for use in different wells.

While there have been described what are presently considered to be the preferred embodiments of the invention, it will be understood that various modifications may be made therein without departing from the spirit or scope of the invention. The present embodiments are therefore to be considered in all respects as illustrative, and not restrictive. The scope of the invention is indicated by the appended claims.

We claim:

1. A self-cycling pump apparatus, comprising:

a pump adapted to be disposed in a submerged subterranean position to lift sub-surface fluids to ground level;

pump cycling means, connected between a source of working fluid and said pump, for alternately establishing a pressurizing mode of operation and a venting mode of operation of said pump;

said pump cycling means being mounted adjacent said pump and communicating with an inlet of a gas actuating chamber of said pump;

timing means connected with said pump cycling means for controlling the sequential timing of said alternate pressurizing and venting modes of operation;

said pump cycling means being connected to said source of working fluid by a drive air supply tube having one end thereof connected to said source of working fluid and the other end thereof connected to said pump cycling means;

an exhaust tube connected to said pump cycling means, said exhaust tube having an end thereof communicating with the atmosphere;

said pump cycling means permitting said drive air supply tube to communicate with said gas chamber of said pump in said pressurizing mode of operation, and sealing-off said drive air supply tube from communication with said gas chamber of said pump in said venting mode of operation;

said pump cycling means permitting said exhaust tube to communicate with said gas chamber of said pump in said venting mode of operation, and sealing-off said exhaust tube from communication with said gas chamber of said pump in said pressurizing mode of operation;

said pump cycling means comprising a three-way valve having an inlet port connected to said drive air supply tube, an exhaust port connected to said exhaust tube, and an outlet port communicating with said gas chamber of said pump;

said timing means including first timing means for controlling the length of time that said valve operates in said pressurizing mode of operation and second timing means for controlling the length of time that said valve operates in said venting mode of operation;

said timing means being connected with said source of working fluid, and being connected with a pilot port of said three-way valve via a pilot line;

said first timing means being adapted to send a pilot signal to said three-way valve to switch said valve from said pressurizing mode of operation to said venting mode of operation when pressurization of said gas chamber of said pump is complete; and said second timing means being adapted to maintain said pilot signal to continue said venting mode of operation only for the length of time required to completely vent said gas chamber of said pump.

2. A self-cycling pump apparatus according to claim 1, wherein:

said three-way valve comprises a normally-open diaphragm-type air valve adapted to close in response to said pilot signal.

3. A self-cycling pump apparatus, comprising:

a pump adapted to be disposed in a submerged subterranean position to lift sub-surface fluids to ground level;

pump cycling means, connected between a source of working fluid and said pump, for alternately establishing a pressurizing mode of operation and a venting mode of operation of said pump;

said pump cycling means being mounted adjacent said pump and communicating with an inlet of a gas actuating chamber of said pump;

timing means connected with said pump cycling means for controlling the sequential timing of said alternate pressurizing and venting modes of operation;

said pump cycling means being connected to said source of working fluid by a drive air supply tube having one end thereof connected to said source of working fluid and the other end thereof connected to said pump cycling means;

an exhaust tube connected to said pump cycling means, said exhaust tube having an end thereof communicating with the atmosphere;

said pump cycling means permitting said drive air supply tube to communicate with said gas chamber of said pump in said pressurizing mode of operation, and sealing-off said drive air supply tube from communication with said gas chamber of said pump in said venting mode of operation;

said pump cycling means permitting said exhaust tube to communicate with said gas chamber of said pump in said venting mode of operation, and sealing-off said exhaust tube from communication with said gas chamber of said pump in said pressurizing mode of operation;

said pump cycling means comprising a three-way valve having an inlet port connected to said drive air supply tube, an exhaust port connected to said exhaust tube, and an outlet port communicating with said gas chamber of said pump;

said timing means including first timing means for controlling the length of time that said valve operates in said pressurizing mode of operation and second timing means for controlling the length of time that said valve operates in said venting mode of operation;

said three-way valve comprising a solenoid-operated spool valve;

an electric solenoid for operating said valve being mounted in a waterproof casing with said valve, said solenoid being connected via electrical conduits with an electric power source; and said timing means comprising solid-state timers mounted in said casing with said valve.

4. A self-cycling pump apparatus, comprising:

a pump adapted to be disposed in a submerged subterranean position to lift sub-surface fluids to ground level;

pump cycling means, connected between a source of working fluid and said pump, for alternately establishing a pressurizing mode of operation and a venting mode of operation of said pump;

said pump cycling means being mounted adjacent said pump and communicating with an inlet of a gas actuating chamber of said pump;

timing means connected with said pump cycling means for controlling the sequential timing of said alternate pressurizing and venting modes of operation;

said pump cycling means being connected to said source of working fluid by a drive air supply tube having one end thereof connected to said source of working fluid and the other end thereof connected to said pump cycling means;

an exhaust tube connected to said pump cycling means, said exhaust tube having an end thereof communicating with the atmosphere;

said pump cycling means permitting said drive air supply tube to communicate with said gas chamber of said pump in said pressurizing mode of operation, and sealing-off said drive air supply tube from communication with said gas chamber of said pump in said venting mode of operation;

said pump cycling means permitting said exhaust tube to communicate with said gas chamber of said pump in said venting mode of operation, and sealing-off said exhaust tube from communication with said gas chamber of said pump in said pressurizing mode of operation;

said pump cycling means comprising a three-way valve having an inlet port connected to said drive air supply tube, an exhaust port connected to said exhaust tube, and an outlet port communicating with said gas chamber of said pump;

said timing means including first timing means for controlling the length of time that said valve operates in said pressurizing mode of operation and second timing means for controlling the length of time that said valve operates in said venting mode of operation;

said pump comprising a bladder pump;

said outlet port of said three-way valve being connected with said gas chamber of said pump by a pressure/vent conduit;

said timing means including valve means operatively connected with said drive air supply tube, said pressure/vent conduit, said exhaust tube and said three-way cycling valve such that said second timing means is defined by said gas chamber of said pump;

said timing means further including a second three-way valve having an outlet port thereof connected with a pilot port of said three-way cycling valve;

said second three-way valve having a pilot port thereof connected with said pressure/vent conduit via a pilot line provided with regulating means, an inlet port thereof connected with said drive air supply tube, and an exhaust port thereof connected with said exhaust tube;

said pilot line regulating means of said second three-way valve comprising said second timing means;

said regulating means being adapted to send a pilot signal to said second three-way valve which operates said second three-way valve so that said inlet port communicates with said outlet port of said second three-way valve to in turn send a pilot signal to said cycling valve to switch said cycling valve from said pressurizing mode of operation to said venting mode of operation when pressurization of said gas chamber of said pump is complete; and said second three-way valve being adapted to remain in said operated state to maintain said pilot signal to said cycling valve to continue said venting mode of operation substantially for the same length of time that it takes said gas chamber of said pump to vent entirely, such that said second timing means is defined by the volume of said gas chamber of said pump.

5. A pump system comprising:

a source of working fluid;

a pump adapted to be disposed to operate at a subterranean position by means of said working fluid;

at least a three-way valve, operatively connected between said source of working fluid and said pump, for establishing alternating modes of operation of said pump;

said valve being disposed adjacent said pump;

said pump being adapted to be submerged in sub-surface fluid in a well to lift said sub-surface fluid to ground level;

said pump including a flexible member disposed in a pump body to divide said pump body into a gas chamber and a fluid chamber;

said alternating modes of operation of said pump comprising a pressurizing mode in which said gas chamber of said pump is pressurized so as to discharge fluid from said pump and a venting mode in which said gas chamber of said pump is vented to permit sub-surface fluid to fill said fluid chamber through an inlet of said pump;

said three-way valve being connected to said source of working fluid by a drive air supply tube having one end thereof connected to said source of working fluid and the other end thereof connected to said three-way valve;

an exhaust tube connected to said three-way valve, said exhaust tube having an end thereof communicating with the atmosphere;

said three-way valve being adapted to permit said drive air supply tube to communicate with said gas chamber of said pump in said pressurizing mode of operation, and to seal-off said drive air supply tube from communication with said gas chamber of said pump in said venting mode of operation;

said three-way valve being adapted to permit said exhaust tube to communicate with said gas chamber of said pump in said venting mode of operation, and to seal-off said exhaust tube from communication with said gas chamber of said pump in said pressurizing mode of operation; and first timing means for controlling the length of time that said valve operates in said pressurizing mode and second timing means for controlling the length of time that said valve operates in said venting mode, said first and second timing means being connected to said three-way valve by a valve pilot line extending up said well, such that said first and second timing means are remote from said valve.

6. A self-controlled pump apparatus, comprising:

a pump adapted to be disposed at a subterranean position, submerged in sub-surface fluid, to lift said sub-surface fluid to ground level;

pump cycling means, connected between a source of working fluid and said pump, for alternately establishing a pressurizing mode of operation and a venting mode of operation of said pump;

said pump cycling means being mounted adjacent said pump and communicating with an inlet of a gas chamber of said pump;

timing means connected with said pump cycling means for controlling the sequential timing of said alternate pressurizing and venting modes of operation, said timing means being mounted adjacent said pump cycling means when said pump is in said submerged position;

a drive air supply tube having one end thereof connected to said source of working fluid and the other end thereof connected to said pump cycling means;

an exhaust tube connected to said pump cycling means, said exhaust tube having an end thereof communicating with the atmosphere;

a pressure/vent conduit connected between said pump cycling means and said gas chamber of said pump;

said pump cycling means permitting said drive air supply tube to communicate with said gas chamber of said pump through said pressure/vent conduit in said pressurizing mode and sealing off said drive air supply tube from communication with said gas chamber of said pump in said venting mode of operation;

said pump cycling means permitting said exhaust tube to communicate with said gas chamber of said pump through said pressure/vent conduit in said venting mode and sealing off said exhaust tube from communication with said gas chamber of said pump in said pressurizing mode;

said pump cycling means comprising a three-way valve having an inlet port connected to said drive air supply tube, an exhaust port connected to said exhaust tube, and an outlet port selectively communicating with said gas chamber of said pump;

said timing means including valve means operatively connected with said drive air supply tube, said pressure/vent conduit, said exhaust tube and said three-way cycling valve such that said timing means is regulated in part by the volume of said gas chamber of said pump;

said timing means including a second three-way valve having an outlet port thereof connected with a pilot port of said three-way cycling valve;

said second three-way valve having a pilot port thereof connected with said pressure/vent conduit via a pilot line provided with regulating means, an inlet port thereof connected with said drive air supply tube, and an exhaust port thereof connected with said exhaust tube;

said pilot line regulating means of said second three-way valve comprising said second timing means;

said regulating means being adapted to send a pilot signal to said second three-way valve which operates said second three-way valve so that said inlet port communicates with said outlet port of said second three-way valve to in turn send a pilot signal to said cycling valve to switch said cycling valve from said pressurizing mode of operation to said venting mode of operation when pressurization of said gas chamber of said pump is complete; and said second three-way valve remains in said operated state to maintain said pilot signal to said cycling valve to continue said venting mode of operation substantially for the same length of time that it takes said gas chamber of said pump to vent entirely, such that said timing means is regulated in part by the volume of said gas chamber of said pump.

7. In a pump apparatus for withdrawing sub-surface fluid from a well, including: a gas-actuated pump adapted to be submerged in sub-surface fluid within said well, said pump having a pump body including a gas chamber and a fluid chamber separated by a flexible bladder, said fluid chamber communicating with said sub-surface fluid in said well through an inlet of said pump when said pump is submerged in said sub-surface fluid; a gas conduit communicating between a source of working fluid and said gas chamber of said pump; and pump cycling means, connected with said gas conduit, for alternately establishing a pressurizing mode of operation and a venting mode of operation of said pump, the improvement comprising:

said pump cycling means being connected between said gas conduit and said gas chamber of said pump, adjacent said pump in said submerged position in said well;

said pump cycling means permitting said gas conduit to communicate with said gas chamber of said pump in said pressurizing mode and sealing off said gas conduit from communication with said gas chamber of said pump in said venting mode;

an exhaust tube connected with said pump cycling means;

said pump cycling means permitting said exhaust tube to communicate with said gas chamber of said pump in said venting mode and sealing off said exhaust tube from communication with said gas chamber of said pump in said pressurizing mode;

timing means connected with said pump cycling means for controlling the sequential timing of said alternate pressurizing and venting modes of operation;

said pump cycling means comprising a three-way valve; and said timing means comprising first timing means for controlling the length of time that said valve operates in said pressurizing mode and second timing means for controlling the length of time that said valve operates in said venting mode, said first and second timing means being connected to said three-way valve by a valve pilot line extending up said well, such that said first and second timing means are remote from said valve.

8. A self-cycling pump apparatus, comprising:

a pump adapted to be disposed in a submerged subterranean position to lift sub-surface fluids to ground level;

pump cycling means, mounted proximal said pump and connected to said pump, and adapted to be connected to a source of working fluid, for establishing a first mode of operation of said pump wherein only pressurization and pump discharge occurs, followed by a separate and distinct second mode of operation of said pump wherein only venting and pump intake occurs; and timing means operably connected with said pump cycling means for controlling the sequential timing of said alternate pressurizing and venting modes of operation.

9. A self-cycling pump apparatus according to claim 8, wherein:

said pump cycling means is adapted to be connected to said source of working fluid by a working fluid supply tube;

an exhaust tube is connected to said pump cycling means; and said pump cycling means permits said working fluid supply tube to communicate with said pump while sealing off said exhaust conduit from said pump during said pressurizing mode of operation, and permits said exhaust conduit to communicate with said pump while sealing off said working fluid supply conduit from said pump during said venting mode of operation.

10. A self-cycling pump apparatus according to claim 9, further comprising:

venting accelerating means, connected to said pump cycling means and said pump, for accelerating the venting of said pump in said venting mode of operation while permitting said working fluid supply tube to communicate with said pump in said pressurizing mode of operation.

11. A self-cycling pump apparatus according to claim 9, wherein:

said pump cycling means comprises a three-way valve having an inlet port connected to said working fluid supply tube, an exhaust port connected to said exhaust tube, and an outlet port communicating with said pump; and said timing means includes first timing means for controlling the length of time that said valve operates in said pressurizing mode of operation and second timing means for controlling the length of time that said valve operates in said venting mode of operation.

12. A self-cycling pump apparatus according to claim 11, further comprising:

venting accelerating means, connected to said pump cycling means and said said pump, for accelerating the venting of said pump in said venting mode of operation while permitting said working fluid supply tube to communicate with said pump in said pressurizing mode of operation; and said venting accelerating means comprising a quick exhaust valve having an inlet port connected with said outlet port of said cycling valve, an outlet port communicating with said pump, and an exhaust port connected to said exhaust tube.

13. A self-cycling pump apparatus according to claim 11, wherein:

said apparatus further comprises flow rate regulating means connected with said source of working fluid;

said source of working fluid comprises a compressed air source; and said flow rate regulating means comprises a valve adapted to regulate the displacement of said compressed air source.

14. A self-cycling pump apparatus according to claim 11, wherein:

said pump comprises a bladder pump; and said outlet port of said three-way valve is connected with said pump by a pressure/vent conduit.

15. A self-cycling pump apparatus according to claim 14, wherein:

said timing means is disposed adjacent said three-way cycling valve at said bladder pump when said bladder pump is in said submerged position, so that said bladder pump is entirely self-controlled with said timing and cycling means thereof being disposed proximal said pump in said submerged position.

16. A self-cycling pump apparatus according to claim 14, wherein:

said timing means includes valve means operatively connected with said working fluid supply tube, said pressure/vent conduit, said exhaust tube and said three-way cycling valve such that said second timing means is defined by a gas chamber of said pump.

17. A self-controlled pump apparatus, comprising:

a pump adapted to be disposed in a submerged subterranean position to lift sub-surface fluids to ground level;

pump cycling means, mounted proximal said pump and connected to said pump, and adapted to be connected to a source of working fluid, for establishing a first mode of operation of said pump wherein only pressurization and pump discharge occurs, followed by a separate and distinct second mode of operation of said pump wherein only venting and pump intake occurs; and timing means operably connected with said pump cycling means for controlling the sequential timing of said alternate pressurizing and venting modes of operation, said timing means being mounted adjacent said pump cycling means when said pump is in said submerged position.

18. A self-controlled pump apparatus according to claim 17, wherein:

said pump cycling means is adapted to be connected to said source of working fluid by a working fluid supply tube;

an exhaust tube is connected to said pump cycling means; and said pump cycling means permits said working fluid supply tube to communicate with said pump while sealing off said exhaust conduit from said pump during said pressurizing mode of operation, and permits said exhaust conduit to communicate with said pump while sealing off said working fluid supply conduit from said pump during said venting mode of operation.

19. A self-controlled pump apparatus according to claim 18, wherein:

said pump cycling means comprises a cycling valve; and said timing means comprises a timing valve operably connected with said cycling valve and said pump so as to maintain said cycling valve in said venting mode of operation for the same length of time that it takes said pump to vent, such that said timing means is regulated in part by the volume of a working fluid chamber of said pump.

20. A self-controlled pump apparatus according to claim 19, wherein:

said cycling valve has an inlet port connected to said source of working fluid by a working fluid supply tube, an exhaust port connected to an exhaust tube, and an outlet port selectively communicating with said pump;

said timing valve is operatively connected with said working fluid supply tube, said exhaust tube, said pump, and a pilot port of said cycling valve;

said timing valve is connected to said pump via regulating means for sending a signal to said timing valve which operates said timing valve to in turn send a signal to said cycling valve, such that said cycling valve is switched from said pressurizing mode of operation to said venting mode of operation when pressurization of said pump is complete; and said timing valve remains in said operated state to maintain said signal to said cycling valve to continue said venting mode of operation substantially for the same length of time that it takes said pump to vent.

21. A self-cycling pump apparatus, comprising:

a pump adapted to be disposed in a submerged subterranean position to lift sub-surface fluids to ground level;

pump cycling means, mounted proximal said pump and connected to said pump, and adapted to be connected to a source of working fluid, for alternately establishing a pressurization mode of operation of said pump and a separate venting mode of operation of said pump; and timing means, operably connected with said pump cycling means, for sending a signal to said pump cycling means to switch from said pressurizing mode of operation to said venting mode of operation when pressurization of said pump is complete, and to maintain said signal to continue said venting mode of operation only for the length of time required to vent said pump.

22. A self-cycling pump apparatus according to claim 21, wherein:

said timing means is arranged with, and operably connected to, said pump in said submerged subterranean position; and said timing means is regulated in part by the volume of a chamber of said pump.

23. A self-cycling pump apparatus according to claim 21, wherein:

said pump cycling means is adapted to be connected to said source of working fluid by a working fluid supply tube;

an exhaust tube is connected to said pump cycling means; and said pump cycling means permits said working fluid supply tube to communicate with said pump while sealing off said exhaust conduit from said pump during said pressurizing mode of operation, and permits said exhaust conduit to communicate with said pump while sealing off said working fluid supply conduit from said pump during said venting mode of operation.

24. A self-cycling pump apparatus according to claim 21, wherein:

said pump comprises a bladder pump having a flexible tubular bladder member arranged in a pump housing so as to define an inner pumping fluid chamber and an outer annular working fluid chamber; and said timing means is arranged externally of said pump housing.

25. In a pump apparatus for lifting sub-surface fluids from a subterranean level to ground level, including: a pump adapted to be submerged in sub-surface fluid at a subterranean position, said pump having a chamber communicating with said sub-surface fluid through an inlet of said pump when said pump is submerged in said sub-surface fluid; a working fluid conduit communicating between said pump and a source of working fluid disposed at ground level; pump cycling means, connected to said source of working fluid and said pump, for alternately establishing a first mode of operation of said pump wherein pressurization and pump discharge occurs, followed by a separate second mode of operation of said pump wherein venting and pump intake occurs; and timing means operably connected with said pump cycling means for controlling the sequential timing of said alternate pressurizing and venting modes of operation, the improvement comprising:

said pump cycling means is arranged with said pump in said subterranean position.

26. A pump apparatus according to claim 25, wherein:

said pump cycling means is connected to said source of working fluid by a working fluid supply tube;

a separate exhaust tube is connected to said pump cycling means;

said pump cycling means permits said working fluid supply tube to communicate with said pump while sealing off said exhaust tube from said pump in said pressurizing mode of operation, and permits said exhaust tube to communicate with said pump while sealing off said working fluid supply tube from said pump in said venting mode of operation.

27. A pump apparatus according to claim 25, wherein:

said timing means is connected with said source of working fluid, and is connected with said pump cycling means so as to send timing signals thereto;

said timing means is adapted to send a first signal to said pump cycling means to switch from said pressurizing mode of operation to said venting mode of operation when pressurization of said pump is complete; and said timing means is further adapted to maintain said signal to continue said venting mode of operation only for the length of time required to vent said pump.

28. A pump apparatus according to claim 26, wherein:

said timing means is also arranged with said pump in said subterranean position.

29. A pump apparatus according to claim 28, wherein:

said timing means is operatively connected with said working fluid supply tube, said pump, said pump cycling means, and said exhaust tube such that the length of time that said pump remains in said venting mode of operation is regulated in part by the volume of said pump.

30. A self-cycling pump apparatus, comprising:

a gas drive pump adapted to be disposed in a submerged subterranean position to lift sub-surface fluids to ground level;

pump cycling means, mounted proximal said pump and connected to said pump, and adapted to be connected to a source of working fluid, for establishing a first mode of operation of said pump wherein only pressurization and pump discharge occurs, followed by a separate and distinct second mode of operation of said pump wherein only venting and pump intake occurs; and timing means operably connected with said pump cycling means for controlling the sequential timing of said alternate pressurizing and venting modes of operation.

31. A self-cycling pump apparatus according to claim 30, wherein:

said timing means is adapted to send a signal to said pump cycling means to switch from said pressurizing mode of operation to said venting mode of operation when pressurization of said pump is complete, and to maintain said signal to continue said venting mode of operation only for the length of time required to vent said pump.

32. A self-cycling pump apparatus according to claim 30, wherein:

said pump cycling means is adapted to be connected to said source of working fluid by a working fluid supply tube;

an exhaust tube is connected to said pump cycling means; and said pump cycling means permits said working fluid supply tube to communicate with said pump while sealing off said exhaust conduit from said pump during said pressurizing mode of operation, and permits said exhaust conduit to communicate with said pump while sealing off said working fluid supply conduit from said pump during said venting mode of operation.

33. A self-cycling pump apparatus according to claim 32, wherein:

said pump cycling means comprises a three-way valve having an inlet port connected to said working fluid supply tube, an exhaust port connected to said exhaust tube, and an outlet port communicating with said pump; and said timing means includes first timing means for controlling the length of time that said valve operates in said pressurizing mode of operation and second timing means for controlling the length of time that said valve operates in said venting mode of operation.

* * * * *

UNITED STATES PATENT AND TRADEMARK OFFICE

CERTIFICATE OF CORRECTION

PATENT NO. : 5,027,902

DATED : July 2, 1991

INVENTOR(S) : Dickinson et al.

Figure 8:
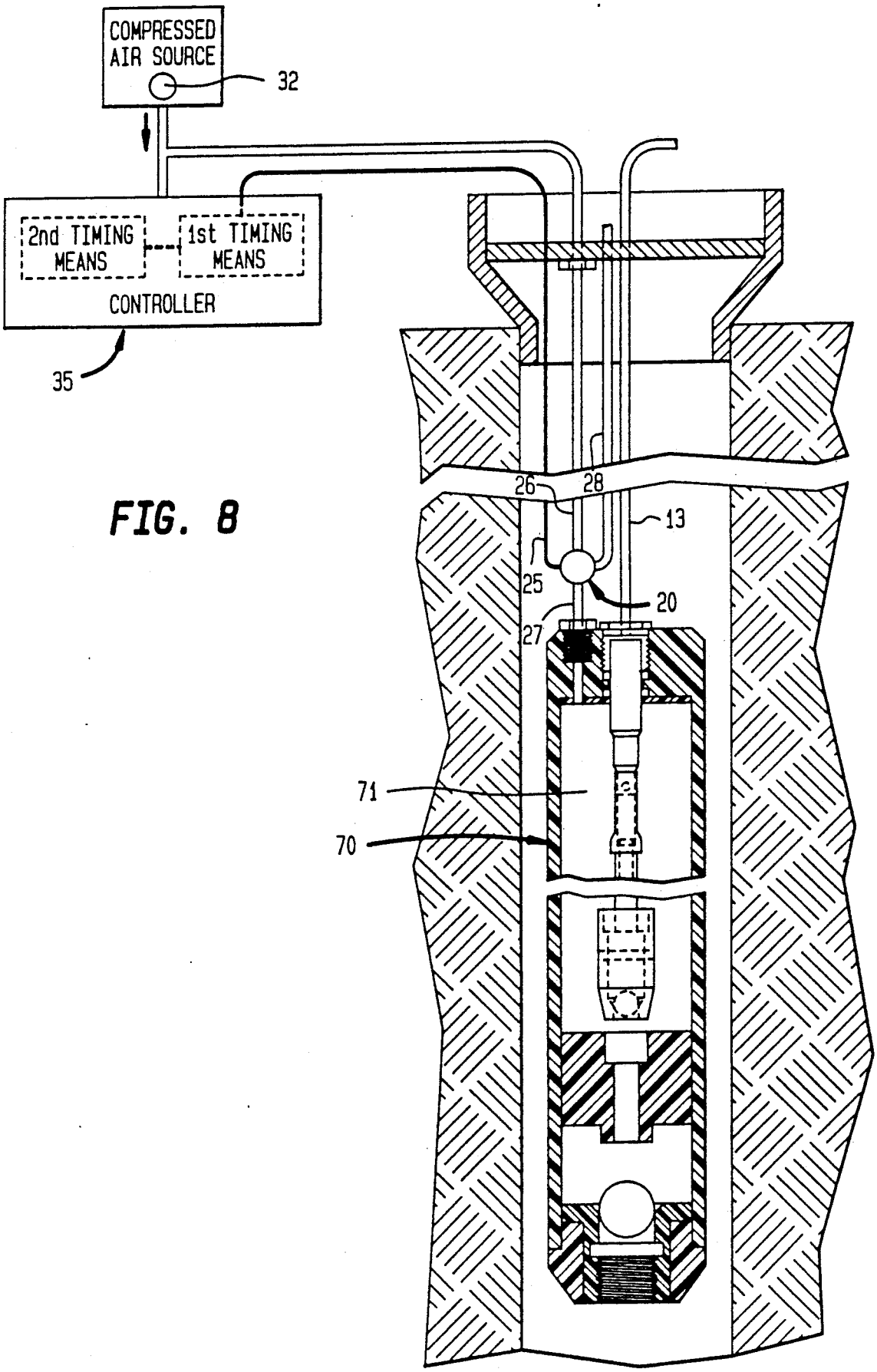
FIG. 8 is a view of a self-cycling gas drive pump according to the first embodiment of the invention.

It is certified that error appears in the above-identified patent and that said Letters Patent is hereby corrected as shown below:

Column 1, line 7, after "to" insert --a--.
Column 4, line 34, change "throught" to --through--.
Column 8, line 42, after "controller" insert --35.--;
Column 8, line 63, after "ment" insert a --.--.
Column 9, line 29, after "vention" insert a --.--.
Column 12, line 30, change "subtantially" to --substantially--.
Column 14, line 30, change "example" to --example, as shown in Figure 8.--;
" , line 30, before the word "cycling" insert --The--.
Column 21, line 13, delete "said" (first occurrence).

Signed and Sealed this

Twentieth Day of October, 1992

*Attest:*

DOUGLAS B. COMER

*Attesting Officer*

*Acting Commissioner of Patents and Trademarks*